US012059633B2

(12) United States Patent
Donaldson et al.

(10) Patent No.: US 12,059,633 B2
(45) Date of Patent: Aug. 13, 2024

(54) METHOD OF CONTROLLING AN INTERACTING TOY CONSTRUCTION MODEL

(71) Applicant: LEGO A/S, Billund (DK)

(72) Inventors: Thomas Alan Donaldson, Billund (DK); Robert George Milner, Hilton (GB); Rosanna Elizabeth Parrish, Cambridge (GB); Simon John Turner, Cambridge (GB); Martin Edward Brock, Cambridge (GB); James Martin Clemoes, Cambridge (GB)

(73) Assignee: LEGO A/S, Billund (DK)

( * ) Notice: Subject to any disclaimer, the term of this patent is extended or adjusted under 35 U.S.C. 154(b) by 276 days.

(21) Appl. No.: 17/427,593

(22) PCT Filed: Dec. 12, 2019

(86) PCT No.: PCT/EP2019/084828
§ 371 (c)(1),
(2) Date: Jul. 30, 2021

(87) PCT Pub. No.: WO2020/156722
PCT Pub. Date: Aug. 6, 2020

(65) Prior Publication Data

US 2022/0161151 A1 May 26, 2022

(30) Foreign Application Priority Data

Jan. 31, 2019 (DK) ..... PA 2019 70076

(51) Int. Cl.
*A63H 33/04* (2006.01)
*A63H 33/08* (2006.01)

(52) U.S. Cl.
CPC ..... *A63H 33/042* (2013.01); *A63H 33/086* (2013.01); *A63H 2200/00* (2013.01)

(58) Field of Classification Search
None
See application file for complete search history.

(56) References Cited

U.S. PATENT DOCUMENTS 6,443,796 B1 9/2002 Shackelford
8,851,953 B2 10/2014 Oschuetz et al.
(Continued)

FOREIGN PATENT DOCUMENTS

WO 2015/173246 A1 11/2015
WO 2018/158357 A2 9/2018

OTHER PUBLICATIONS

Search Opinion and Search Report issued in corresponding Danish patent application No. PA 2019 70076, Jun. 14, 2019, 8 pages.
(Continued)

*Primary Examiner* — Damon J Pierce
(74) *Attorney, Agent, or Firm* — Day Pitney LLP; George Chaclas; Anthony A. Kassas

(57) ABSTRACT

The present invention relates to a method of controlling an ensemble of interacting toy construction models. The interacting toy construction models include toy construction elements having functional toy construction elements, the toy construction elements include coupling members configured for detachably interconnecting the toy construction elements with each other. The functional toy construction elements may perform a function in compliance with a configuration defining a functional behaviour. The method includes configuring the functional toy construction elements in the interacting toy construction models based on information on further functional toy construction elements in said interacting toy construction model to coordinate their functional behaviour in a model-behaviour; and further adapting the model-behaviour based on information on further interacting toy construction models in the ensemble. The invention also elates to a toy construction set for
(Continued)

constructing an interacting toy construction model and a toy construction system comprising at least two interacting toy construction models.

13 Claims, 4 Drawing Sheets

(56) References Cited

U.S. PATENT DOCUMENTS

| | | | | |
|---|---|---|---|---|
| 2013/0217294 | A1 | 8/2013 | Karunaratne | |
| 2017/0144083 | A1 * | 5/2017 | Kærsgaard ..... | A63H 33/086 |

OTHER PUBLICATIONS

New Lego Education Coding Express 45025 | Learn to Code with Trains for Preschoolers, Cathleen's Toy Reviews, Sep. 7, 2018, [online], retrieved from the Internet Jun. 11, 2019 URL: https://www.youtube.com/watch?v=2AjU7KqA060.

Brio, Brio World—33834 Smart Tech Engine with Action Tunnels and 33874 Washing Station, Aug. 13, 2017 [online], retrieved from the Internet Jun. 14, 2019. URL: https://www.youtube.com/watch?v=Rs2XdZHt7lc.

International Search Report and Written Opinion of the International Searching Authority issued in corresponding International patent application No. PCT/EP2019/084828, mailed Apr. 28, 2020, 10 pages.

* cited by examiner

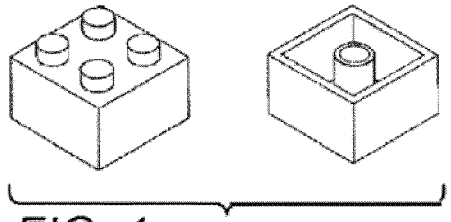
FIG. 1 - PRIOR ART
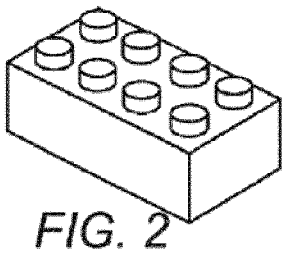
FIG. 2
PRIOR ART
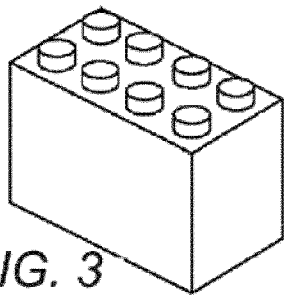
FIG. 3
PRIOR ART
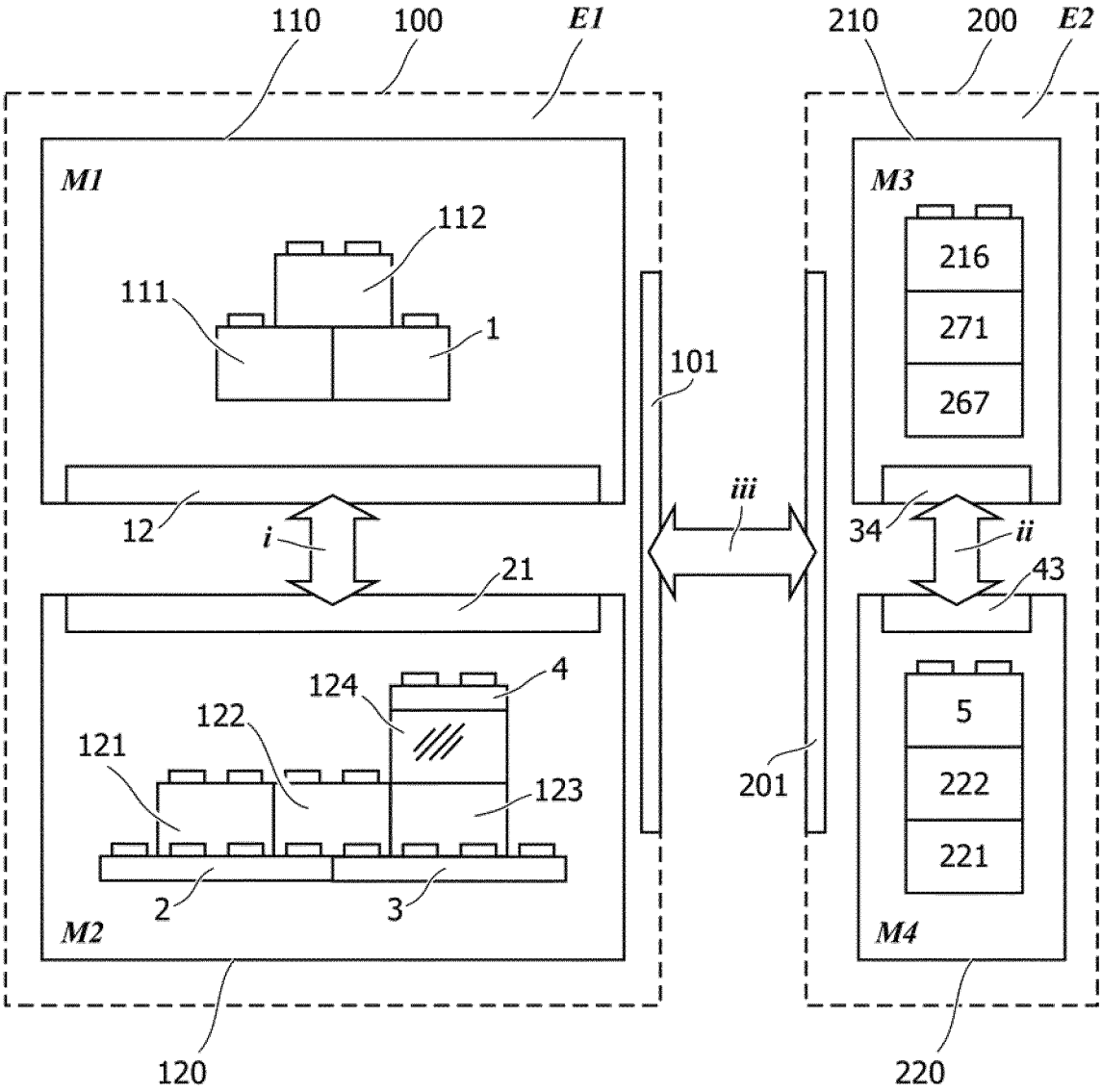
Fig. 4

METHOD OF CONTROLLING AN INTERACTING TOY CONSTRUCTION MODEL

CROSS-REFERENCE TO RELATED APPLICATIONS

This application is a U.S. National Stage of International Application No. PCT/EP2019/084828, filed on Dec. 12, 2019 and published on Aug. 6, 2020, as WO 2020/156722 A1, which claims the benefit of priority to Danish Patent Application No. PA 2019 70076, filed on Jan. 31, 2019. The content of each of the above referenced patent applications is incorporated herein by reference in its entirety for any purpose whatsoever.

The present invention relates in one aspect to a method of controlling an ensemble of multiple interacting toy construction models. In a further aspect, the invention relates to a toy construction set for constructing an interacting toy construction model adapted for use in the method. According to a yet further aspect, the invention relates to a toy construction system comprising at least two interacting toy construction models adapted for use in the method.

BACKGROUND OF THE INVENTION

Toy construction systems with toy construction elements having coupling members for detachably interconnecting the toy construction elements with each other have been known for decades. These toy construction systems are typically for model building. Over the time the purely mechanical conventional toy construction elements have been enhanced in various ways by adding electromagnetic functionality, such as battery-driven light and motor functions. More recently, robotic toy construction systems as well as toy construction systems including virtual play have greatly added to the interactive experience and educational value of such toy construction systems. However, these interactive toy construction systems have only promoted the desire of enhancing the functionality and interactive nature of the physical toy construction elements to the point of being able to animate constructed models to live. One of the challenges in this context is to stimulate and involve multiple players in a challenging social game play with physical toy construction models in a manner that is easy and intuitive to use and build with, yet highly flexible and scalable.

SUMMARY OF THE INVENTION

In one aspect, the invention provides a method of controlling an ensemble of multiple interacting toy construction models, wherein each of the interacting toy construction models in the ensemble comprises a plurality of toy construction elements, the plurality including multiple functional toy construction elements, wherein each of the toy construction elements comprises coupling members configured for detachably interconnecting the toy construction elements with each other, and wherein each of the functional toy construction elements is operable to perform a function in compliance with a configuration defining a functional behaviour. The method comprises configuring one or more of the functional toy construction elements in at least one of the interacting toy construction models of the ensemble based on information on further functional toy construction elements in said at least one interacting toy construction model, so as to coordinate the functional behaviour of the functional toy construction elements in a model-behaviour for said at least one interacting toy construction model; the method further comprises adapting the model-behaviour based on information on further interacting toy construction models in the ensemble.

Thereby a system for constructing user-operable interacting toy construction models is provided each including a plurality of functional elements, each functional element providing a respective functionality. The individual functional toy construction elements may be configured so as to align their functional behaviour into a coordinated functional behaviour for the model to which they belong, thus defining a basic model-behaviour. The model behaviour may e.g. be formulated in terms of parameters and programmed instructions in a processor with associated memory and may further comprise or at least exploit further information and instructions regarding the interaction with other interacting toy construction elements and/or regarding a context. The information and instructions regarding the interaction with other interacting toy construction models may be consolidated into an interface included in the model-behaviour e.g. in the form of a corresponding data-structure. The context may refer, for example, to one or more of an affiliation with a pre-defined group of toy construction models, association with a particular user-profile, a particular theme, and/or a physical location. The context may e.g. be reflected by grouping multiple interacting toy construction models into an ensemble under one or more of these context-related attributes. Adapting the model-behaviour to include information on further interacting toy construction elements in the ensemble thus provides an interface facilitating the interaction of the user-constructed model with the further toy-construction models in the ensemble.

The system is thus conceived to allow a user to freely construct interacting models, which are then configured to determine a model-behaviour based on the available functionality, to interact with each other, and to adapt their respective model-behaviours in response to the presence of and/or interactions with further (user-constructed) toy construction models.

Since compatible coupling elements are provided on all the toy construction elements, they may interchangeably be connected to each other, and the same functional toy construction element may be used (or re-used) in different toy construction models constructed from the same system. Thereby free model building is facilitated and supported. Advantageously, the toy construction models may further include passive toy construction elements, i.e. toy construction models that do not exhibit any functionality beyond the mechanical coupling. Thereby the possibilities for free model building are further enhanced.

The term "passive" as used herein with regard to toy construction elements refers to the absence of additional functionality beyond the mere interconnection by means of the coupling members, in particular to the absence of any additional functionality as implemented in the functional toy construction elements.

The term "functional toy construction elements" refers to toy construction elements with a capability of performing a function. Performing the function may include input, processing and/or output, typically in response to a control signal. Advantageously according to some embodiments, the function may be controlled in a digital manner, e.g. in response to digital control signals using a digital signal processor. For example, functional toy construction elements may be adapted to perform electrical and/or electronic functions e.g. sensor functions, motor functions, indicator functions, lighting functions, user operable input and/or switching functions, data communication, data storage, signal handling and/or transmission functions, data and/or signal processing functions, or combinations thereof. Further, functional toy construction elements may also be adapted to perform display functions. Further, functional toy construction elements may also be adapted to perform power supply functions.

According to some embodiments, the combined model-behaviours of the toy construction models in the ensemble define an ensemble-behaviour. Advantageously, the method further comprises adapting the ensemble-behaviour of the ensemble, based on information on one or more further ensembles. Thereby an interaction between interacting toy construction models from different ensembles is facilitated as formulated in the ensemble-behaviour, which again may include an interface interacting with other ensembles. Advantageously, interacting toy construction models belonging to different models may interact with each other through such an interface of the ensemble-behaviour.

A particular advantage of the method of controlling an ensemble of multiple interacting toy construction models is that it supports a flexible and modularly scalable physical multi-player game play allowing multiple users to synergistically contribute and participate with their respective interacting toy construction models. Users may gather and add their respective interacting toy construction models and/or ensembles of interacting toy construction models to a combined physical multi-player universe using the method according to embodiments of the invention. Using the method, a play universe may be created, expanded and scaled in a modular and flexible manner, allowing multiple players to participate with their respective contribution. The models may be brought together in the same location to communicate and interact locally, or even interact remotely via a networking infrastructure. A user retiring from the game play may then remove (or disconnect) her/his respective interacting toy construction models and/or ensembles from the play universe. Using the method, remaining toy construction models and/or ensembles in the play universe may than be controlled to return to a state that is unaware of the removed (or disconnected) models and/or ensembles.

Further according to some embodiments, the method further comprises monitoring for any change with respect to said at least one interacting toy construction model and/or with respect to the ensemble, and configuring one or more functional toy construction elements in said at least one interacting toy construction model and/or adapting the model-behaviour in response to any detected change.

Further according to some embodiments, the method further comprises adapting the ensemble-behaviour in response to any detected change.

Further according to some embodiments of the method, the detected change is one or more of:

- a modification of an interacting toy construction model in the ensemble by addition or removal of a functional toy construction element;
- a modification of the ensemble by addition or removal of an interacting toy construction model;
- an addition or removal of a further ensemble comprising one or more interacting toy construction models.
- a user interaction with said at least one interacting toy construction model; and
- an interaction between said at least one interacting toy construction model and a further interacting toy construction model.

Further according to some embodiments of the method, addition, interaction, or removal, of a given model in an ensemble respectively comprises establishing, communicating through, or terminating, a network link between the given model and at least one component in the ensemble.

Further according to some embodiments of the method, a network infrastructure for the network link is one or more of a wide area network (WAN), local area network (LAN), or wireless communication based, such as using near field wireless communication.

Further according to some embodiments of the method, initializing and/or operating said at least one interacting toy construction model in the ensemble comprises broadcasting information about said at least one interacting toy construction model to further interacting toy construction models in the ensemble and/or receiving at said at least one interacting toy construction model information about further interacting toy construction models in the ensemble.

Further according to some embodiments, the method further comprises detecting the functional toy construction elements present in said at least one interacting toy construction model;

Further according to some embodiments, the method further comprises determining the relative position of the detected functional toy construction elements with respect to each other.

In a further aspect, the invention relates to a toy construction set for the construction of an interacting toy construction model, the toy construction set comprising a plurality of toy construction elements including multiple functional toy construction elements, wherein each of the toy construction elements comprises coupling members configured for detachably interconnecting the toy construction elements with each other so as to construct a toy construction model comprising multiple functional toy construction elements, wherein each of the functional toy construction elements is operable to perform a function in compliance with a configuration defining a functional behaviour; the toy construction set comprising at least one processor with programmed instructions to configure one or more of the functional toy construction elements in an interacting toy construction model constructed from the toy construction set, based on information on further functional toy construction elements in the interacting toy construction model, so as to coordinate their functional behaviour in a model-behaviour.

Advantageously according to some embodiments, the interacting toy construction model is configured to be part of an ensemble of interacting toy construction models, and the processor further comprises programmed instructions to adapt the model-behaviour based on information on further interacting toy construction models.

Advantageously according to some embodiments, the functional toy construction elements are adapted for communicating with each other: to sense mutual presence; to determine a relative position with respect to each other; to exchange information on the functional behaviours; and/or for purposes of timing, triggering, and/or synchronization.

Advantageously according to some embodiments, one or more of the functional toy construction elements comprises one or more of a transducer device, a processor, a data-storage device, and a power source, such as a battery, an energy harvesting device, and/or electrical contacts for connecting an external power supply.

In combination the functional toy construction elements of a model constructed from the toy construction set form a functional aggregate having a model functional behaviour.

Further advantageous embodiments of the toy construction set according to the invention are evident from the discussion of the method for controlling an ensemble of interacting toy construction elements and of the toy construction system comprising at least two interacting toy construction models as disclosed herein, wherein analogue advantages are achieved.

In a yet further aspect, the invention relates to a toy construction system comprising at least two interacting toy construction models, wherein each of the interacting toy construction models comprises a plurality of toy construction elements, the plurality including multiple functional toy construction elements, wherein each of the toy construction elements comprises coupling members configured for detachably interconnecting the toy construction elements with each other, and wherein each of the functional toy construction elements is operable to perform a function in compliance with a configuration defining a functional behaviour. The toy construction system thus comprises a first toy construction set for the construction of a first interacting toy construction model and a second toy construction set for the construction of a second interacting toy construction model.

One or more, or each of the functional toy construction elements in the first interacting toy construction model may be configured based on information on at least the second interacting toy construction model, so as to coordinate the functional behaviour of the functional toy construction elements of the first interacting toy construction model in a first basic model-behaviour. Further, one or more, or each of the functional toy construction elements in the second interacting toy construction model may be configured based on information on at least the first interacting toy construction model, so as to coordinate the functional behaviour of the functional toy construction elements of the second interacting toy construction model in a second basic model-behaviour. Advantageously, the first model-behaviour is further adapted based on information on at least the second interacting toy construction model, and/or the second model-behaviour is further adapted based on information on at least the first interacting toy construction model.

The first and second model-behaviours may further include information and instructions for interacting with the first and second interacting toy construction models, respectively. Preferably, the first and second model-behaviours may define respective interfaces for interacting with the first and second interacting toy construction models, respectively.

Advantageously according to some embodiments, the first and second interacting toy construction models are configured to be part of an ensemble of interacting toy construction models, and the respective processor associated with each of the interacting toy construction models further comprises programmed instructions to adapt the model-behaviour based on information on further interacting toy construction models. The combined model-behaviours of the toy construction models in the ensemble define an ensemble-behaviour, which may be further adapted based on information on one or more further ensembles. Preferably, the ensemble includes an interface for interacting with ensemble.

BRIEF DESCRIPTION OF THE DRAWINGS

In the following, the invention will be described in more detail in connection with the appended drawing, which shows in FIG. 1-3 prior art passive toy construction elements;

FIG. 4 schematically, a meta-ensemble of two ensembles of interacting toy construction models and a method of controlling the ensembles;

DETAILED DESCRIPTION

Figure 5:
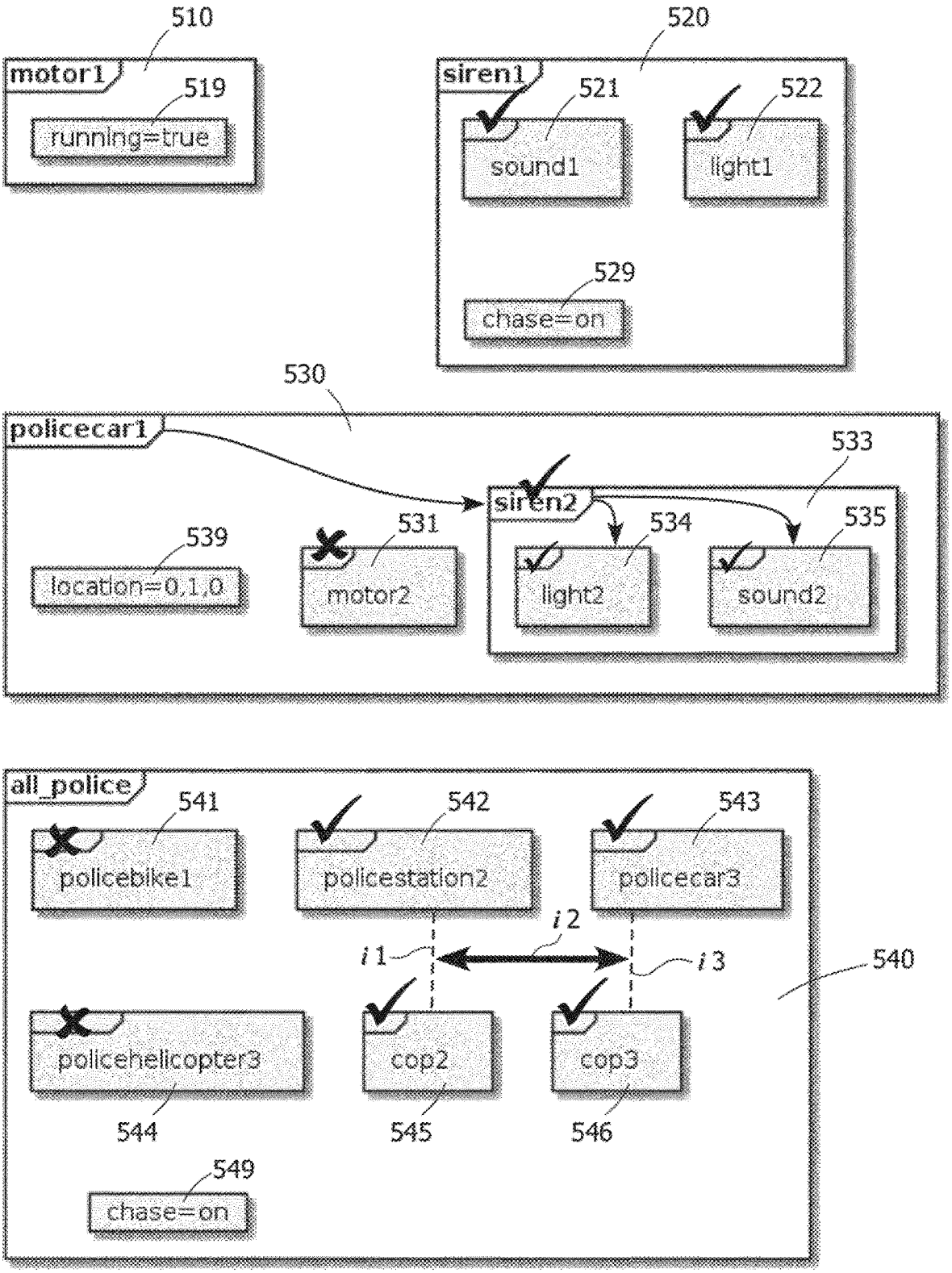
FIG. 5 examples of node sets for an implementation supporting the dynamic adaptation of the functional behaviour of interacting items.

Various aspects and embodiments of toy construction systems that are enhanced by display toy construction elements as disclosed herein will now be described with reference to toy construction elements in the form of bricks. However, the invention may be applied to other forms of construction elements for use in toy construction sets.

FIG. 1 shows a toy construction element with coupling studs on its top surface and a cavity extending into the brick from the bottom. The cavity has a central tube, and coupling studs on another brick can be received in the cavity in a frictional engagement as disclosed in U.S. Pat. No. 3,005,282. FIGS. 2 and 3 show other such prior art construction elements. The construction elements shown in the remaining figures have this known type of coupling members in the form of cooperating studs and cavities. However, other types of coupling members may also be used in addition to or instead of the studs and cavities. The coupling studs are arranged in a square planar grid, i.e. defining orthogonal directions along which sequences of coupling studs are arranged. The distance between neighbouring coupling studs is uniform and equal in both directions. This or similar arrangements of coupling members at coupling locations defining a regular planar grid allow the toy construction elements to be interconnected in a discrete number of positions and orientations relative to each other, in particular at right angles with respect to each other. The toy construction elements shown here, in FIGS. 1-3, are of the passive type, without additional functionality beyond mechanical model building, such as electromagnetic, electronic, optical, or the like.

Referring to FIG. 4 in the following, a toy construction system comprising two ensembles E1, E2 of multiple interacting toy construction models M1, M2, M3, M4 and a method of controlling the ensembles is described. A first ensemble E1 comprises two interacting toy construction models M1, M2, and a second ensemble E2 comprises two further interacting toy construction models M3, M4.

By way of example, the first ensemble E1 may be grouped under the theme "police" and may be associated with a first user (not shown), e.g. via a corresponding first user profile (not shown). The first ensemble E1 comprises a first interacting toy construction model M1 representing, e.g. a police car constructed from two functional toy construction elements 111, 112 and a passive toy construction element 1. A first functional toy construction element 111 may support sound functions; and a second functional toy construction element 112 communicating with the first one 111 may e.g. support light functions. The passive toy construction element 1 integrates with the functional toy construction elements 111, 112, and completes the model to achieve a shape that resembles a car, thereby enhancing the model building possibilities. In combination, the functional toy construction elements 111, 112 define the functionality available in the first model M1. The functional toy construction elements 111, 112 may be configured to coordinate their behaviour in a model-behaviour 110 of the first model M1, here for a police car. For example, a sound component of the first functional toy construction element 111 may be configured to generate car chase motor sounds, a police siren, or the like. Furthermore, the second functional toy construction element 112 supporting light functions may be configured to generate blue lights blinking in a sequence that is characteristic for modern police cars. The first ensemble E1 further comprises a second interacting toy construction model M2 representing, e.g. a police station constructed from four functional toy construction elements 121, 122, 123, 124, for performing functions, and passive toy construction elements 2, 3, 4 for enhanced integral model building. The combined functionality of the police station may e.g. include power supply 121, data processing and storage 122, sound/speech 123, and alarm lighting 124, which are configured for a police station model-behaviour 120. Based on the information that a police station is present as a further interacting toy construction model M2 in the first ensemble E1, the model-behaviour 110 of the first model M1 may be adapted to account for the expanded functionality, and thus for the extended possibilities for gameplay. For example, the model-behaviour 110 may be adapted to include police radio speech in the functional repertoire, based on the information that the ensemble comprises a police station as a further interacting toy construction model M2. In an analogue fashion, the model-behaviour 120 of the second interacting toy construction model M2, here the police station, may be adapted to account for the first interacting toy construction model M1, the police car, in the ensemble. For example, a speech engine may be extended with vocabulary, phrases, and intonation parameters for radio communication addressed from the police station to the police car, and/or parallel instructions for operating the sound and light functions of the police car, and furthermore showing alarm lights in the station at the same time. Advantageously, the model-behaviours 110, 120 comprise respective interfaces 12, 21 providing information and instructions regarding the interaction with the first and second models M1, M2, respectively. The interaction between the interacting toy construction models M1, M2 may thus occur through respective model-behaviour 110, 120 interfaces 12, 21 as indicated by block arrow i. The models may be configured to (automatically) detect each other, and may further interact through the interfaces 12, 21, so as to provide a combined platform for game play that synergistically benefits from the combined functionality of the interacting toy construction models M1, M2 in the ensemble E1. A physical infrastructure for the interaction may be provided through networking capabilities built into the models and/or into one or more, or each of the functional toy construction elements. Preferably, the networking capability is based on any suitable known wireless communication technique.

By way of example, the second ensemble E2 may be grouped under the theme "burglary" and may be associated with a second user (not shown), e.g. via a corresponding second user profile (not shown). The second ensemble E2 comprises a third interacting toy construction model M3 representing, e.g. a burglar figure constructed from three functional toy construction elements 216, 271, 267. The functional toy construction elements 216, 271, 267 may e.g. include a first functional toy construction element 216 that forms a head of a figure that may be detachably connected to a body formed of a torso 271 and legs 267. The head 271 may be equipped with a remotely readable data storage function that identifies the figure as a burglar. The body 271, 267 may e.g. be equipped with sound/speech capability, which is configured to be compliant with a model-behaviour 210 of the model M3 reflecting a burglar's language and/or conduct. The "burglary" ensemble" E2 further comprises a fourth interacting toy construction model M4, here a house, constructed from two functional toy construction elements 221, 222 representing walls and floors of the building, and passive toy construction elements 5 representing a roof top. The functional toy construction elements 221, 222 may, for example, include a sound component and a nearfield sensor adapted for scanning for, and remotely reading, data storage means. The model-behaviour 220 of the interacting toy construction model M4 may further be adapted based on the information about the interacting toy construction model M3 being a burglar. In the context of the "burglary" theme of the second ensemble E2, the functional toy construction elements 221, 222 may thus be configured to provide a burglary alarm function to the interacting toy construction model M4. The functional toy construction elements 221, 222 of the burglary protected house model M4, may then be operated e.g. to sense the presence of the burglar in the vicinity, for example by a near-field reading of the corresponding identification information provided in the burglar, and to cause a corresponding action, such as sounding a burglar alarm or voicing a call for help. Advantageously also in the second ensemble E2, the interaction between the interacting toy construction models M3, M4 may occur through respective model-behaviour interfaces 34, 43 as indicated by block arrow ii.

Each of the ensembles E1, E2 have respective ensemble behaviours 100, 200. When the two users decide to join the ensembles, e.g. by bringing the ensembles E1, E2 together in the same location or by establishing a network link between the ensembles E1, E2, the ensemble behaviours 100, 200 may be mutually adapted to the presence of the other ensemble E2, E1. For example, the "police" ensemble may now be expanded with functionality for receiving burglary alarm calls, sending out instructions (e.g. via sound elements) to catch the burglar, or the like. Correspondingly, the ensemble-behaviour of the "burglary" ensemble may now be adapted to include functionalities for calling the police, or for aborting an attempted burglary and mimicking an escape from the police coming after the burglar. Advantageously, the interaction between the ensembles E1, E2 may occur through respective ensemble-behaviour interfaces 101, 201 as indicated by block arrow iii.

Further ensembles may be added to create a larger play universe, e.g. by adding a "fire brigade" ensemble, a "city" ensemble, etc., and/or by adding further interacting models to any of the ensembles. The toy construction system thus supports a flexible and modularly scalable physical multi-player game play that is capable of a complexity far beyond of what is illustrated in FIG. 4, where multiple users can synergistically contribute and participate with their respective interacting toy construction models. The users may thus construct their own interacting toy construction models, and may gather and add their respective interacting toy construction models and/or ensembles of interacting toy construction models to a combined physical multi-player universe using the method according to embodiments of the invention as already described above.

Figure 6:
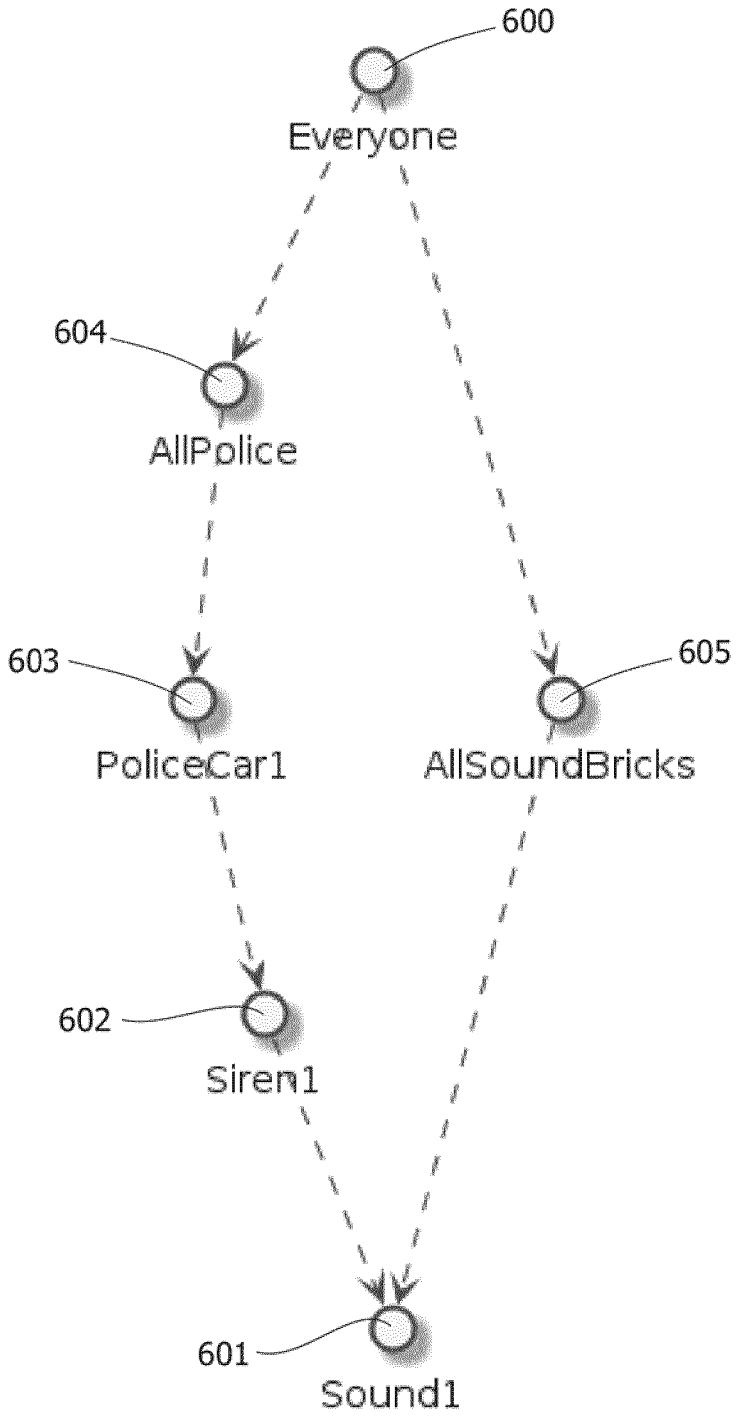
FIG. 6 an example of different node set stacks as seen from the aspect of a single node, for an implementation supporting the dynamic adaptation of the functional behaviour of interacting items; and in FIG. 7 an example of information flow in node sets for an implementation supporting the dynamic adaptation of the functional behaviour of interacting items.

By way of example, and turning to FIGS. 5-7 in the following, an implementation supporting the dynamic adaptation of the functional behaviour of interacting items is now described. The example illustrates the adaptive nature of the functional behaviour, by interaction of the items in a scene. As becomes evident, the items in a scene may change and are adapted accordingly. The adaptation of the interacting items to changes in the scene is preferably performed dynamically, in an automated manner, typically in response to detecting a change in the scene, which may be monitored for the occurrence of such changes. An adaptation of the interacting items may also be performed in response to a user input.

A scene may comprise annotated-node sets describing the functional behaviour of different interacting items arranged in a multi-level but not necessarily hierarchical system. An adaptation of the functional behaviour may thus be implemented as update(s) to one or more node sets included in the scene. FIG. 5 shows examples of node sets 510, 520, 530, 540.

In a very simple example, the functional behaviour of a model comprising a motor may be described in a node set 510 to have two states as annotated with a status parameter representing whether the motor is running (running=true) or not (running=false). Depending on the level of control available for the motor functionality, the functional behaviour may also be described in a slightly more specific way, e.g. by providing a speed and/or a direction. Such more specific annotations may be provided alternatively or in addition to less specific annotations.

Another example of such an interacting item is a model comprising a siren as described by the node set 520. Node set 520 describes that the siren comprises a sound functionality 521 and a light functionality 522, as e.g. provided by means of functional toy construction elements adapted to emit user perceptible sound and light output, respectively, according to programmed instructions. The sound and light output may be controlled by a status parameter 529 labelled "chase", whereby predetermined sound and light sequences are output when "chase=on", and whereby output is switched off when "chase=off". The actual sound and light sequences used may be configured for that functional behaviour when identifying that the sound and light nodes 521, 522 form part of a siren 520 with a "chase" functionality. The "chase" functionality may be determined, for example, by detecting that the functional toy construction elements forming the siren actually form part of a police car model.

The functional behaviour of a model, such as the above-mentioned police car model, may be defined in a model level node set 530. The model level node set 530 consolidates the available functionalities through the included nodes and node sets. The model level node set 530 thus facilitates configuring one or more of the functional toy construction elements in the interacting toy construction model based on information on further functional toy construction elements in said at least one interacting toy construction model, to coordinate their functional behaviour in a model-behaviour. In a further example, the functional behaviour of the above-mentioned police car model may thus be described by a node set 530, which may comprise a location annotation 539, a motor node 531, and a siren node set 533 with a light node 534 and a sound node 535. When prompted, e.g. upon initializing the police car model for play, the police car node set 530 may detect the presence of a siren node set 533, with an active light node 534 and an active sound node 535 as indicated by the check marks, and may detect the unavailability of a motor node 531 as indicated by the cross. The police car node set 530 can then pass configuration information to the siren node set 533, which may use that information in order to configure the light and sound nodes 534, 535 to comply with the current context of the police car model. Furthermore when prompted, e.g. due to a detected change in the scene of play, the police car node set may be updated. For example, the update may include the activation of the motor node in response to the detection of a motor control function in the scene. Upon the detection of a motor control function, the police car node set may thus adapt the functional behaviour of the police car to include the control of motor output. The node set structure thus facilitates a dynamic configuration of the functional behaviour of a toy construction model constructed from a plurality of toy construction elements, the plurality at least comprising multiple functional toy construction elements.

Furthermore, the model-behaviour of interacting toy construction models in an ensemble of toy construction models may be consolidated in an ensemble level node set 540. The model-behaviour of one or more interacting toy construction models may thus be adapted based on information on further interacting toy construction models in the ensemble. In a yet further example of a node set, a node set 540 "all_police" may define the functional behaviour of an ensemble comprising a plurality of toy construction models as defined in respective node sets 541, 542, 543, 544, 545, 546 and one or more status parameters 549. When prompted by an event, such as the above-mentioned initialization or change events, the all_police node 540 may detect the models present in a play scene and which are associated with each other to form an ensemble. For example, the all_police node set 540 may determine the presence of a police station as defined by node set 542, a police car as defined by node set 543, and two police figure models as defined by node sets 545, 546, as indicated by the check marks. Police motorbikes, as defined by node set 541, and police helicopters, as defined by node set 544, that otherwise may be accommodated by the all_police node set 540 may be absent from the scene, or inactive, as indicated by the crosses, and are thus disregarded when configuring the functional behaviour of the ensemble of police models as defined in node set 540.

Analysing the play scene, the police car having node set 543 may be associated with the police figure model having node set 546, e.g. in response to detecting that the police figure model has been placed inside the police car. The sound functionality of the police car node set 543 may then be updated to include loudspeaker talk sequences, thereby interacting to enhance the functional behaviour in a synergistic manner as indicated by broken line i3, beyond the mere additive combination of the functional behaviours of the individual models. Correspondingly, the police station having node set 542 and the police figure model having node set 545 may interact to provide a synergistically enhanced functionality, as indicated by broken line i1, e.g. in response to placing the police figure model with node set 545 on the police station model with node set 542. Detecting the presence of the manned police car model with node sets 543, 546 and the manned police station with node sets 542, 545 in the ensemble 540, the functional behaviour of the ensemble 540 may be further enhanced synergistically, e.g. to now add the functionality of police radio talk sequences between the manned models, through interaction as indicated by the double arrow i2. Thereby, a synergistically enhanced functional behaviour can be implemented, which can be configured in a dynamic manner. The configuration may each time be developed according to an event triggering an update of one or more of the node sets, such as events related to the initialization of a scene, detection of a change in the scene, or as prompted by a user input or by an at least partial, if not complete, analysis of the scene.

One or more interacting items in the scene may be controlled according to their functional behaviour as defined in the node sets, by setting the parameters and/or invoking the functionalities provided therein. For example, a parameter setting may be propagated throughout the ensemble 540 to all nodes sets for which a given status parameter is relevant, and the node sets concerned may be updated accordingly with the corresponding parameter setting. For example, the status parameter annotation 549 "chase=on" may be used to control the overall behaviour of the ensemble 540, here illustrated by setting "chase=on". The status may then be propagated throughout the ensemble 540 to all nodes sets for which "chase=on" is relevant, and the node sets may then be updated accordingly. Thereby, the functional behaviour of the models in the ensemble As mentioned above, the node sets describing a scene may be grouped and stacked in levels to reflect their physical aggregation. Referring to the above examples, node sets may be grouped into a component with multiple elements, such as the siren comprising a sound element and a light element; into a toy construction model, such as the police car example comprising the siren; and further into an all-police-ensemble comprising e.g. police vehicle, police station, and police figure models. A given node set in the stack may thus have subsets as seen in a direction towards lower levels, and may be have supersets as seen in a direction towards higher levels. Seen from the aspect of a single node describing, for example, the functional behaviour of a given functional toy construction element (like the sound and light elements), the scene comprises the superset stack. The single node is thus linked to the corresponding superset stack, as illustrated in FIG. 6 for the example of a sound brick node 601 included in a siren component node set 602, which is part of a police car model node set 603, which in turn is included in the all-police-ensemble node stack 604, all under the umbrella of a global node set 600. As also illustrated in FIG. 6, the single node may also see an alternative stack sequence: here the sound brick 601 is also associated with the superset 605 for all sound bricks, again under the umbrella of the global node set 600.

Figure 7:
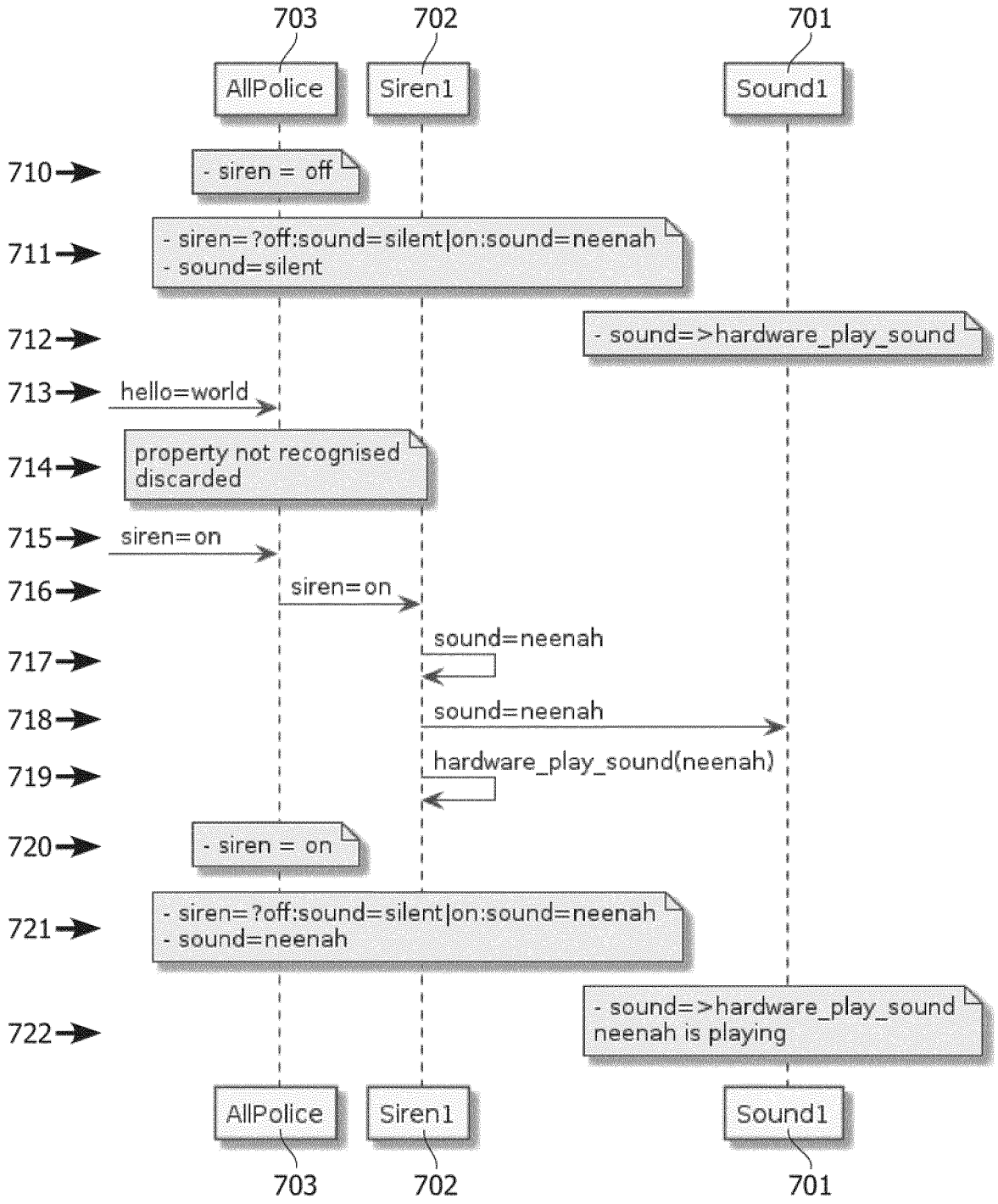

Advantageously, non-unitary node sets are provided to simplify information flow between interacting items. Typically, a change in the play scene leads to a message providing updates to the properties of a given node set, which are propagated through the structure of said node set. Referring to the above-mentioned example of a play scene with interacting toy construction models around a police theme, for any node set, and given an update to an individual property, the following may occur:

- no propagation to either supersets or subsets
  - if a non-police-vehicle receives an update that sirens should go on, no propagation is required
- propagation to subsets, without transformation
  - a police vehicle receives an update that sirens should go on, which is propagated to the light brick and sound brick members
- propagation to subsets with transformation
  - a vehicle is moved and rotated. The new positions for its constituent elements are calculated
- propagation to supersets without transformation
  - an element in a model receives indication that something has entered proximity. The node set representing the model should receive indication that something has entered its proximity
- propagation to supersets with transformation
  - an element in a vehicle notices that it has been moved. The vehicle node set centroid should be recalculated Propagation down the stack (towards subsets) can be achieved without any newly transmitted messages: if a message has been received by a member of a node set, it will be available for that node through all the subsets of that node set. Downwards propagation can then be simply performed by property comparison:

- if a subset does not have a property of the same name as the superset, the property is not downwardly propagated, and propagation stops
- if a subset does have a property of the same name and its marked as a direct property, the property is copied
- if a subset has a property of the same name marked as an indirect property, the property is transformed according to the indirection By way of example, FIG. 7 illustrates how information is dealt with through the node set structure. Considering the node sets as aggregated in the stack above with the following properties:

AllPolice 703 (at 710)
  siren=off
  Siren1 702 (at 711)
  siren=?off:sound=silentlon:sound=neenah
  sound=silent
Sound1 701 (at 712)
  sound=>hardware_play_sound If AllPolice 703 receives a message hello=world (at 713), the message will be discarded (at 714), because the property hello is not recognised. If AllPolice 703 receives a message siren=on (at 715) which sets the property siren=on, then Siren1 702 receives the message siren=on (at 716) which is handled indirectly to set the property sound=neenah (at 717). Then Sound1 receives the message sound=neenah (at 718) which sets the property sound=neenah. Since Sound1 is the base node set, setting the sound to neenah actually causes the neenah sound to play (at 719). The node set status is then reflected in AllPolice 703 by the following properties:

AllPolice 703 (at 720)
  siren=on
Siren1 702 (at 721)
  siren=?off:sound=silentlon:sound=neenah
  sound=neenah
Sound1 701 (at 722)
  sound=>hardware_play_sound
  neenah is playing For property indirection, the following instructions may be used:

- (none) direct setting
- ? parse the following characters as a I-separated list of (match):(property)=(newvalue)
- process through the named function For upwards propagation, a new message needs to be broadcast as members may have disregarded the message.

The invention claimed is:

1. A method of controlling an ensemble of multiple interacting toy construction models, wherein each of the interacting toy construction models in the ensemble comprises a plurality of toy construction elements, the plurality including multiple functional toy construction elements, wherein each of the toy construction elements comprises coupling members configured for detachably interconnecting the toy construction elements with each other, and wherein each of the functional toy construction elements is operable to perform a function in compliance with a configuration defining a functional behaviour;

the method comprising:

configuring the functional behaviour of one or more of the functional toy construction elements in at least one of the interacting toy construction models of the ensemble based on information on further functional toy construction elements in said at least one interacting toy construction model, so as to coordinate their functional behaviour in a model-behaviour; and further adapting the model-behaviour based on information on further interacting toy construction models in the ensemble.

2. The method according to claim 1, wherein a combined model-behaviours of the toy construction models in the ensemble define an ensemble-behaviour, the method further comprising adapting the ensemble-behaviour of the ensemble, based on information on one or more further ensembles.

3. The method according to claim 1, the method further comprising monitoring for any change with respect to said at least one interacting toy construction model and/or with respect to the ensemble, and configuring one or more functional toy construction elements in said at least one interacting toy construction model and/or adapting the model-behaviour in response to any detected change.

4. The method according to claim 3, the method further comprising adapting the ensemble-behaviour in response to any detected change.

5. The method according to claim 4, wherein the detected change is one or more of:

a modification of an interacting toy construction model in the ensemble by addition or removal of a functional toy construction element;

a modification of the ensemble by addition or removal of an interacting toy construction model;

an addition or removal of a further ensemble comprising one or more interacting toy construction models;

a user interaction with said at least one interacting toy construction model; and an interaction between said at least one interacting toy construction model and a further interacting toy construction model.

6. The method according to claim 5, wherein addition, interaction, or removal, of a given model in an ensemble respectively comprises establishing, communicating through, or terminating, a network link between the given model and at least one component in the ensemble.

7. The method according to claim 6, wherein a network infrastructure for the network link is one or more of a wide area network (WAN), local area network (LAN), or wireless communication based, such as using near field wireless communication.

8. The method according to claim 1, the method further comprising initializing and/or operating said at least one interacting toy construction model in the ensemble, wherein initializing and/or operating said at least on interacting toy construction model in the ensemble comprises broadcasting information about said at least one interacting toy construction model to further interacting toy construction models in the ensemble and/or receiving at said at least one interacting toy construction model information about further interacting toy construction models in the ensemble.

9. The method according to claim 1, the method further comprising detecting the functional toy construction elements present in said at least one interacting toy construction model.

10. The method according to claim 9, the method further comprising determining a relative position of the detected functional toy construction elements with respect to each other.

11. A toy construction system comprising:

a first toy construction set for construction of a first interacting toy construction model and a second toy construction set for construction of a second interacting toy construction model, wherein each of the first and second interacting toy construction models comprises a plurality of toy construction elements, the plurality including multiple functional toy construction elements, wherein each of the toy construction elements comprises coupling members configured for detachably interconnecting the toy construction elements with each other, and wherein each of the functional toy construction elements is operable to perform a function in compliance with a configuration defining a functional behaviour;

the toy construction system further comprising at least one processing device configured to configure one or more of the functional toy construction elements in the first interacting toy construction model constructed from the first toy construction set, based on information on further functional toy construction elements in the first interacting toy construction model, so as to coordinate their functional behaviour in a first model-behaviour, and to configure one or more of the functional toy construction elements in the second interacting toy construction model constructed from the second toy construction set, based on information on further functional toy construction elements in the second interacting toy construction model, so as to coordinate their functional behaviour in a second model-behaviour; and to adapt the first model-behaviour based on information on at least the second interacting toy construction model.

12. The toy construction system according to claim 11, wherein the processing device is further configured to adapt the second model-behaviour based on information on at least the first interacting toy construction model.

13. A method of coordinating an ensemble of multiple interacting toy construction models, each interacting toy construction model formed of a plurality of functional toy construction elements, the method comprising the steps of:

coordinating functions of the plurality of functional toy construction elements which form each respective interacting toy construction model to define a model behaviour;

configuring a first ensemble of at least two of the multiple interacting toy construction models such that the two interacting toy construction models adapt and expand individual functions based on information of interacting toy construction models in the first ensemble defining a first ensemble behaviour;

configuring a second ensemble of at least two of the multiple interacting toy construction models such that the two interacting toy construction models adapt and expand individual functions based on information of interacting toy construction models in the second ensemble defining a second ensemble behaviour; and interacting the first and second ensemble, expanding the first ensemble behaviour based on information of interacting toy construction models in the second ensemble.

* * * * *